US005952599A

United States Patent [19]

Dolby et al.

[11] Patent Number: 5,952,599

[45] Date of Patent: Sep. 14, 1999

[54] INTERACTIVE MUSIC GENERATION SYSTEM MAKING USE OF GLOBAL FEATURE CONTROL BY NON-MUSICIANS

[75] Inventors: Thomas Dolby, San Mateo; Tom Dougherty, Los Altos; John Eichenseer, San Francisco; William Martens, Cupertino; Michael Mills, Palo Alto; Joy S. Mountford, Mountain View, all of Calif.

[73] Assignee: Interval Research Corporation, Palo Alto, Calif.

[21] Appl. No.: 08/977,377

[22] Filed: Nov. 24, 1997

[51] Int. Cl.[6] ..... G10H 1/00; G10H 1/02; G10H 1/36

[52] U.S. Cl. ..... 84/649; 84/609; 84/610; 84/626; 84/634; 84/650; 84/662; 84/477 R

[58] Field of Search ..... 84/609–610, 612, 84/615, 622–623, 626, 628, 633–634, 636, 649–650, 652, 659, 662, 665–666, 668, 477 R, 478

[56] References Cited

U.S. PATENT DOCUMENTS

| | | | |
|---|---|---|---|
| 4,526,078 | 7/1985 | Chadabe | 84/1.03 |
| 4,716,804 | 1/1988 | Chadabe | 84/1.03 |
| 4,885,969 | 12/1989 | Chesters | 84/1.01 |
| 4,988,981 | 1/1991 | Zimmerman et al. | 340/709 |
| 5,097,252 | 3/1992 | Harvill | 340/540 |
| 5,315,057 | 5/1994 | Land et al. | 84/601 |
| 5,325,423 | 6/1994 | Lewis | 379/90 |

OTHER PUBLICATIONS

Metois, et al., "BROWeb: An Interactive Collaborative Auditory Environment on the World Wide Web", distributed at International Conference on Auditory Display, (Palo Alto, CA, Nov. 4, 1996), pp. 105–110.

Hinckley, et al., "A Survey of Design Issues in Spatial Input", UIST '94, Nov. 2–4, 1994, pp. 213–222.

*Primary Examiner*—William M. Shoop, Jr.
*Assistant Examiner*—Marlon T. Fletcher
*Attorney, Agent, or Firm*—Pennie & Edmonds, LLP

[57] ABSTRACT

An improved music generation system that facilitates artistic expression by non-musician and musician performers in both individual and group performance contexts. Mappings are provided between 1) gestures of a performer as indicated by manipulation of a user input device, 2) displayed motion of a graphic object, and 3) global features of a musical segment. The displayed motions and global features are selected so as to reinforce the appearance of causation between the performer's gestures and the produced musical effects and thereby assist the performer in refining his or her musical expression. The displayed motion is isomorphically coherent with the musical segment in order to achieve the appearance of causation. The global features are segment characteristics perceivable to human listeners. Control at the global feature level in combination with isomorphic visual feedback provides advantages to both non-musicians and musicians in producing artistic effect.

35 Claims, 8 Drawing Sheets

Mappings Between Gestures, Display and Music

| | Mouse Gesture | Display | Musical Effect |
|---|---|---|---|
| Deform graphic object and play deforming sound | Momentarily tap on left mouse button with no mouse movement when button is released. | Graphic object deforms. | Glissando up and down in relation to height of graphic object |
| Spin graphic object and play spinning sound | Momentarily tap on left mouse button with move movement when button is released. | Graphic object spins, gradually decreasing rotation speed until spinning stops. Speed and direction of rotation depend on magnitude and direction of mouse velocity when button is released. | Embellishment (e.g., grace note) with gross trajectory. Speed of notes follows rotation speed. No sound after spinning stops. |
| Roll graphic and play rolling sound | Continuous depression of left mouse button with no mouse movement when button is released. | Graphic object rolls (translation and rotation). Lateral movement moves object left and right. Vertical movement moves object nearer or farther from viewer's position in scene. After button is released object returns to initial position. | Wandering melodic patterns with many fast notes of equal duration. Pitch content changes with axis of rotation. Speed of notes varies with speed of rotation. After motion stops, musical segment ends. |
| Throw graphic object and play throwing sound (boomerang effect) | Continuous depression of left mouse button with mouse movement when button is released. | Rolling until button is released. Begins to fly in same direction after button is released. Then it returns to initial position (same as rolling until button is released. | Speed of notes and volume decrease with distance of object. Glissando up and down with height of object. |

Fig. 4

"Deform"

"Spin"

"Roll"

"Fly"

INTERACTIVE MUSIC GENERATION SYSTEM MAKING USE OF GLOBAL FEATURE CONTROL BY NON-MUSICIANS

BACKGROUND OF THE INVENTION

The present invention relates to an interactive music generation system of particular use to non-musician performers.

The use of computers in generating music provides advantages unavailable in conventional instruments. These include 1) the generation of a very broad range of sounds using a single device, 2) the possibility of having a graphical display that displays effects correlated to the currently generated sound, and 3) storage and retrieval of note sequences.

The benefits of computer music have up until now been primarily limited to musicians having performance skills similar to those employed in playing conventional instruments. Although, non-musicians can be easily trained to use a computer-based music system to generate sounds, achieving an artistic effect satisfying to the user is difficult. Like its conventional forebears, the computer-based instrument is generally controlled on a note-by-note basis requiring great dexterity to provide quality output. Furthermore, even if the non-musician is sufficiently dexterous to control note characteristics as desired in real-time, he or she in general does not know how to create an input to produce a desired artistic effect.

One approach to easing the generation of music is disclosed in U.S. Pat. No. 4,526,078 issued to Chadabe. This patent discusses in great generality the use of a computerized device to produce music wherein some musical parameters may be automatically generated and others are selected responsive to real-time user input. However, in that patent, music generation is either entirely manual and subject to the previously discussed limitations or automatic to the extent that creative control is greatly limited. What is needed is an improved music generation system readily usable by non-musician performers.

SUMMARY OF THE INVENTION

The present invention provides an improved music generation system that facilitates artistic expression by non-musician and musician performers in both individual and group performance contexts. In one embodiment, mappings are provided between 1) gestures of a performer as indicated by manipulation of a user input device, 2) displayed motion of a graphic object, and 3) global features of a musical segment with the terms "global features" and "musical segment" being defined herein. The displayed motions and global features are selected so as to reinforce the appearance of causation between the performer's gestures and the produced musical effects and thereby assist the performer in refining his or her musical expression. In some embodiments, the displayed motion is isomorphically coherent (in some sense matching) with the musical segment in order to achieve the appearance of causation. The global features are segment characteristics exhibiting patterns perceivable by human listeners. It should be noted that control at the global feature level in combination with isomorphic visual feedback provides advantages to both non-musicians and musicians in producing artistic effect.

In some embodiments, the present invention also facilitates collaborative music generation. Collaborating performers share a virtual visual environment with each other. Individual performers may separately control independent global features of a musical segment. Alternatively, the input of multiple performers may be integrated to control a single global feature.

In accordance with a first aspect of the invention, a computer-implemented method for interactively generating music includes steps of: receiving a first sequence of performance gestures from a first human performer via a first input device, receiving a second sequence of performance gestures from a second human performer via a second input device, varying an appearance of graphic objects in a visual display space responsive to the first sequence and the second sequence, displaying a first perspective of the visual display space to the first human performer, displaying a second perspective of the visual display space to the second human performer, wherein the first perspective and the second perspective are non-identical, and generating musical sound responsive to the first sequence and the second sequence, wherein at least one particular performance gesture of one of the first and second sequences causes a musical segment that follows the particular performance gesture with global features selected in accordance with at least one performance gesture.

In accordance with a second aspect of the invention, a computer implemented method for interactively generating music includes steps of: providing a user input device that generates a position signal and at least one selection signal responsive to a user manipulation of the user input device, monitoring the position signal and at least one selection signal, displaying a graphic object, varying an appearance of the graphic object responsive to at least one position signal and/or at least one selection signal, and generating a musical segment having at least one global feature selected responsive to at least one of the monitored position signals and/or at least one selection signal, wherein the musical segment is isomorphically coherent with variation in the appearance of the graphic object.

In accordance with a third aspect of the invention, a computer implemented method for interactively generating music includes steps of: receiving a first performance gesture from a first human performer via a first input device, receiving a second performance gesture from a second human performer via a second input device, varying an appearance of one or more graphic objects in a visual display space responsive to the first performance gesture and the second performance gesture, and generating a musical segment with one or more global features specified in response to the first performance gesture and the second performance gesture.

A further understanding of the nature and advantages of the inventions herein may be realized by reference to the remaining portions of the specification and the attached drawings.

BRIEF DESCRIPTION OF THE DRAWINGS

FIG. 4 depicts a table showing mappings between input gestures, virtual object movement, and musical effects in accordance with one embodiment of the present invention.

DESCRIPTION OF SPECIFIC EMBODIMENTS

Definitions and Terminology

The present discussion deals with computer generation of music. In this context, the term "musical segment" refers to a sequence of notes, varying in pitch, loudness, duration, and/or other characteristics. A musical segment potentially has some note onsets synchronized to produce simultaneous voicing of notes, thus allowing for chords and harmony.

The term "global feature" refers to a segment characteristic exhibiting patterns readily perceivable by a human listener which patterns depend upon the sound of more than one note. Examples of global features include the shape of a pitch contour of the musical segment, an identifiable rhythm pattern, or the shape of a volume contour of the musical segment.

Other terms will be explained below after necessary background is discussed.

Overview of the Present Invention

The present invention provides an interactive music generation system wherein one or more performers need not control the characteristics of individual notes in real time. Instead, the performer controls global features of a musical segment. Thus, complex musical output can be produced with significantly less complex input while the complexity of the musical output need not be dependent in an obvious or direct way upon the performer control input. The present invention also allows for collaboration with multiple performers having the ability to jointly control a single music generation process. Multiple performers may together control a single global feature of a musical segment or each control different global features of a musical segment. Visual feedback in the form of movement or mutation of graphic objects in a visual display space reinforces a sense of causation between performer control input and music output.

The description below will begin with presentation of representative suitable hardware for implementing the present invention. The visual display space used will then be explained generally. The remainder of the description will then concern the mappings between control inputs, music generation, and displayed changes in graphic objects. These mappings will be explained separately for the single performer context and the multiple performer context.

Computer Hardware Suitable for Implementing the Present Invention

Figure 1:
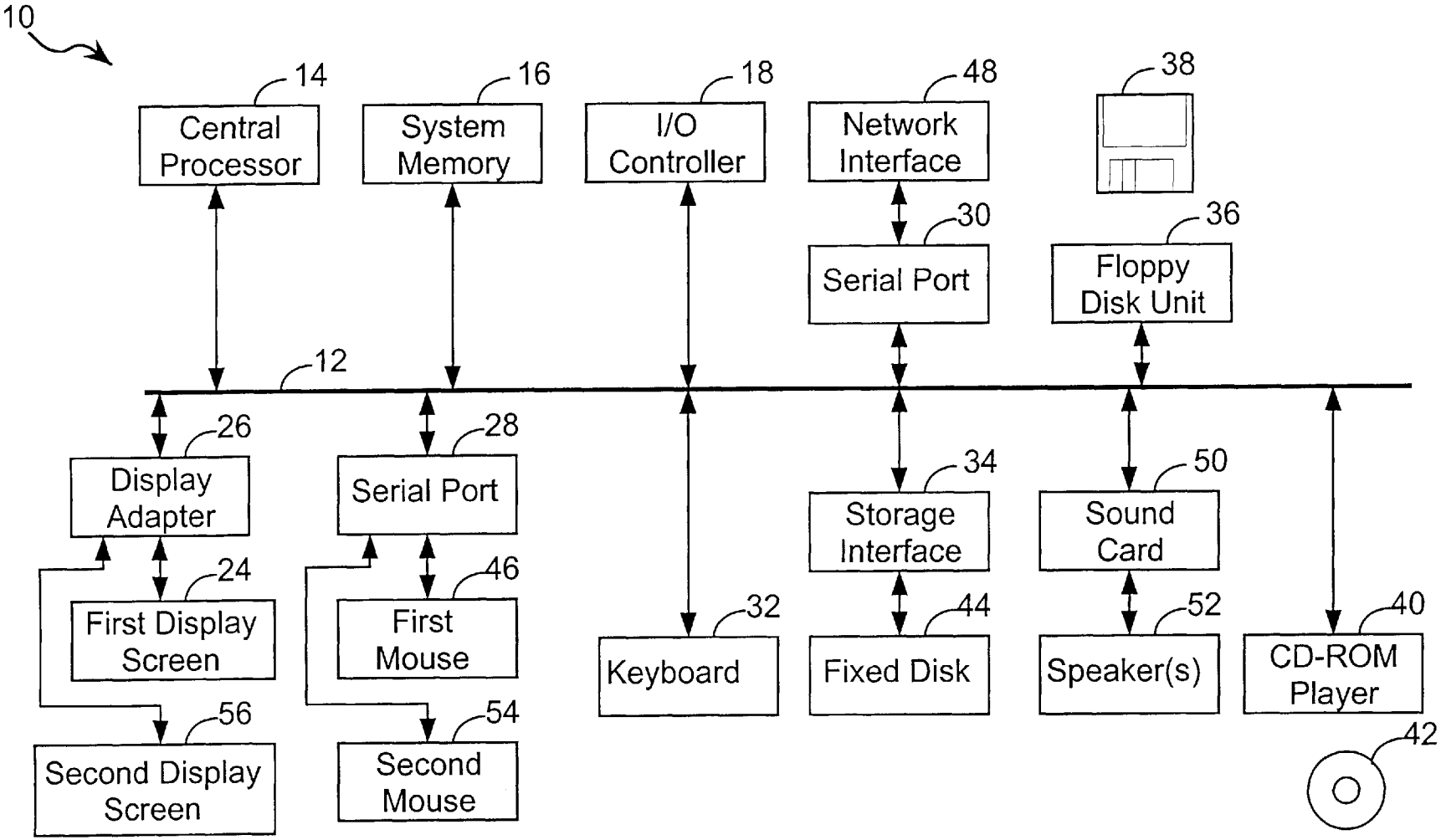
FIG. 1 depicts a representative computer system suitable for implementing the present invention.

FIG. 1 depicts a block diagram of a host computer system 10 suitable for implementing the present invention. Host computer system 10 includes a bus 12 which interconnects major subsystems such as a central processor 14, a system memory 16 (typically RAM), an input/output (I/O) controller 18, an external device such as a first display screen 24 via display adapter 26, serial ports 28 and 30, a keyboard 32, a storage interface 34, a floppy disk drive 36 operative to receive a floppy disk 38, and a CD-ROM player 40 operative to receive a CD-ROM 42. Storage interface 34 may connect to a fixed disk drive 44. Fixed disk drive 44 may be a part of host computer system 10 or may be separate and accessed through other interface systems. Many other devices can be connected such as a first mouse 46 connected via serial port 28 and a network interface 48 connected via serial port 30. First mouse 46 generates a position signal responsive to movement over a surface at least one selection signal responsive to depression of a button. Network interface 48 may provide a direct connection to a remote computer system via any type of network. A sound card 50 produces signals to drive one or more speakers 52. The sound card is preferably any sound laser compatible sound card. Many other devices or subsystems (not shown) may be connected in a similar manner.

Under the control of appropriate software as herein described, host computer system 10 functions as an interactive music generation tool. By use of first mouse 46, a single performer may generate sounds through speakers 52. First display screen 24 may function as a visual feedback device showing images corresponding to the generated sounds. The present invention also envisions multiple performers using host computer system 10. To facilitate collaboration among multiple performers, host computer system 10 may additionally incorporate a second mouse 54 and/or a second display screen 56, or may instead incorporate two separate views on a single display screen.

Also, it is not necessary for all of the devices shown in FIG. 1 to be present to practice the present invention. The devices and subsystems may be interconnected in different ways from that shown in FIG. 1. The operation of a computer system such as that shown in FIG. 1 is readily known in the art and is not discussed in detail in this application. Code to implement the present invention may be operably disposed or permanently stored in computer-readable storage media such as system memory 16, fixed disk 44, floppy disk 38, or CD-ROM 42.

Figure 2:
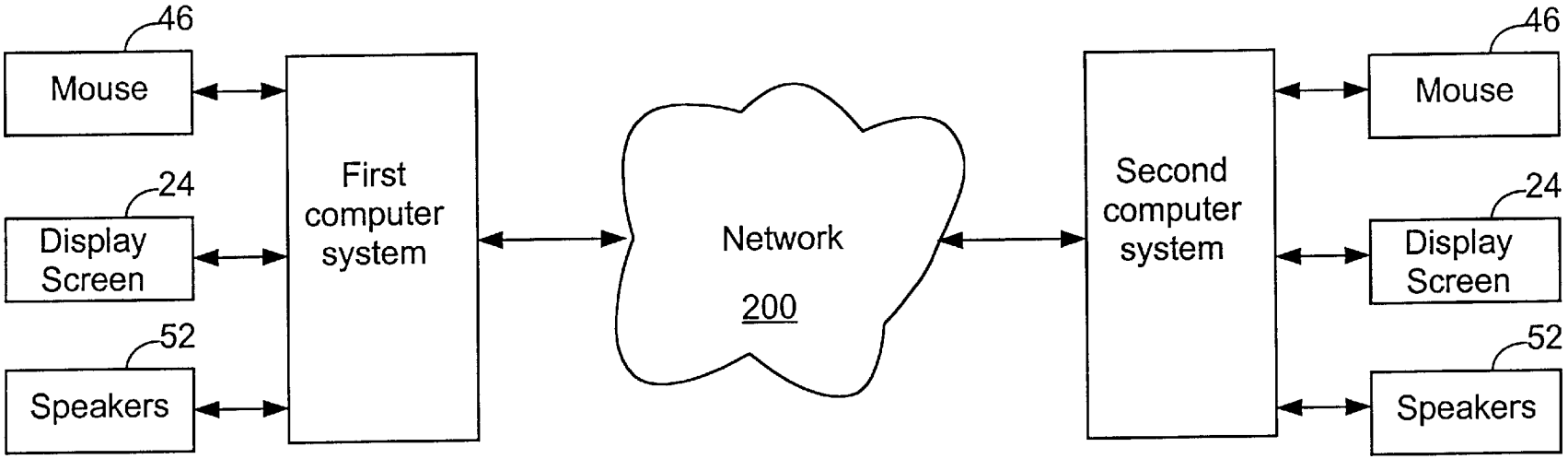
FIG. 2 depicts a representative computer network suitable for implementing the present invention.

Collaboration between multiple performers may also be facilitated by a network interconnecting multiple computer systems. FIG. 2 depicts a representative computer network suitable for implementing the present invention. A network 200 interconnects two computer systems 10, each equipped with mouse 46, display screen 24 and speakers 52. Computer systems 10 may exchange information via network 200 to facilitate a collaboration between two performers, each performer hearing a jointly produced musical performance and viewing accompanying graphics on his or her display screen 24. As will be discussed in further detail below, each display screen 24 may show an independent perspective of a display space.

Visual Display Space

Figure 3:
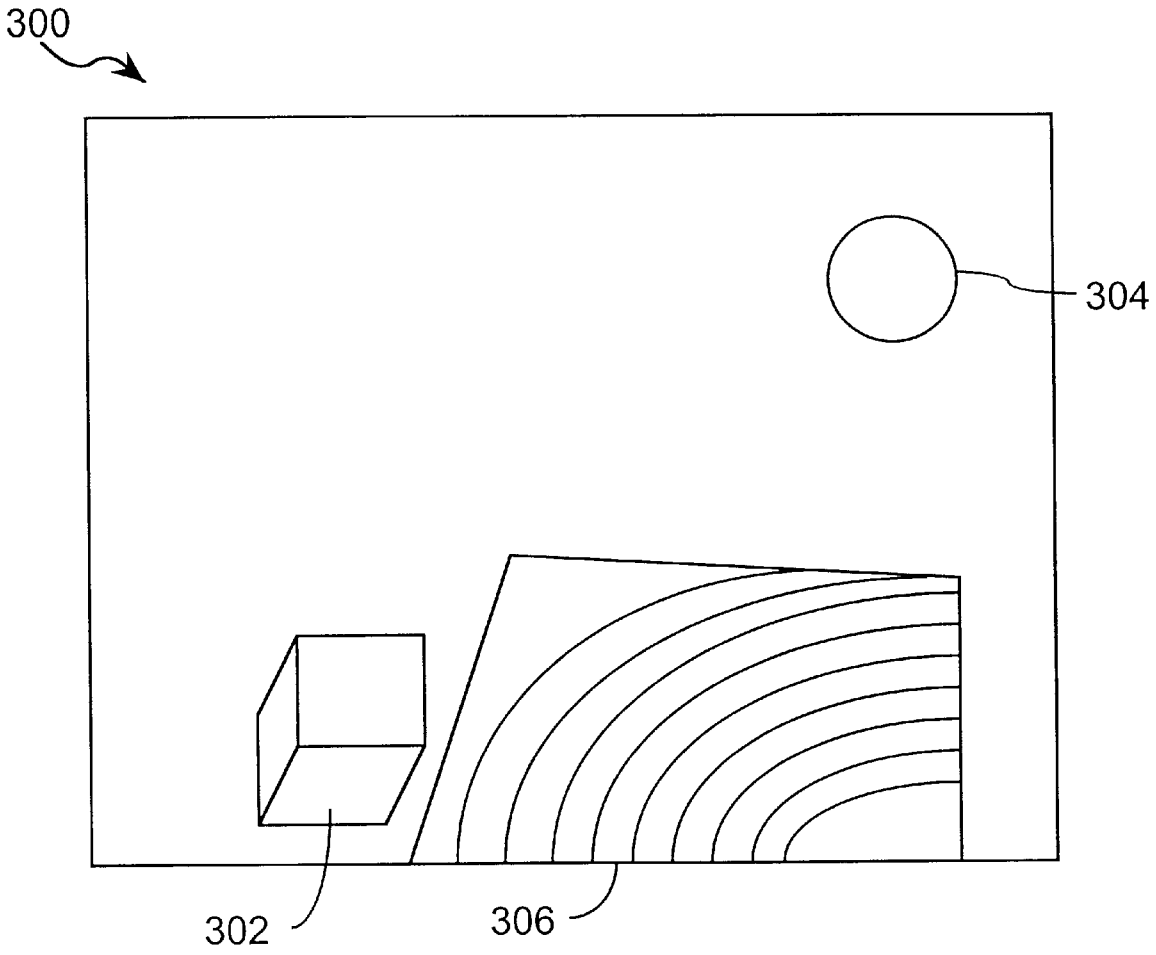
FIG. 3 depicts a visual display space with multiple graphic objects in accordance with one embodiment of the present invention.

FIG. 3 depicts a visual display space 300 with two graphic objects 302 and 304 and a surface 306 in accordance with one embodiment of the present invention. Visual display space 300, displayed objects 302 and 304, and surface 306 are preferably rendered via three-dimensional graphics but represented in two dimensions on first display screen 24. In operation, objects 302 and 304 move through visual display space 300 under user control but generally in accordance with dynamic laws which partially mimic the laws of motion of the physical world. In one embodiment, visual display space 300 is implemented using the mTropolis multimedia development tool available from mFactory of Burlingame, Calif.

In some embodiments, only one of graphic objects 302 and 304 is presented. In others, both graphic objects 302 and 304 are presented but the motion of each is controlled by two performers. The two performers may use either the same computer system 10 or two independent computer systems 10 connected by network 200. Of course, any number of graphic objects may be displayed within the scope of the present invention. It should also be noted that more than one performer may control a single graphic object.

When there is more than one graphic object, the present invention further provides that a different perspective may be provided to each of two or more performers so that each performer may see a close-in view of his or her own graphic object. If two performers are using the same computer system 10, both perspectives may be displayed on first display screen 24, e.g., in separate windows. Alternatively, one perspective may be displayed on first display screen 24 and another perspective on second display screen 56. In the network context, each display screen 24 presents a different perspective.

Mappings for Single Performer System

FIG. 4 depicts a table showing mappings between user control input, activity within visual display space 300, and music output for a single performer in accordance with one embodiment of the present invention. In a preferred embodiment, user control input is in the form of user manipulation of a mouse such as first mouse 46. For a two-button mouse, the left control button will be considered to be the one used, although this is, of course, a design choice or even to be left to be configured by the user. The discussion will assume use of a mouse although the present invention contemplates any input device or combination of input devices capable of generating at least one position signal and at least one selection signal such as, e.g., a trackball, joystick, etc.

In one embodiment, a common characteristic of the mappings between user manipulations, display activity, and musical output is isomorphic coherence; user manipulations, the display activity, and musical output are perceived by the user to have the same "shape." This reinforces the appearance of causation between the user input and the musical output. A performance gesture is herein defined as, e.g., a user manipulation of an input device isomorphically coherent with either expected musical output or expected display activity.

Figure 5:
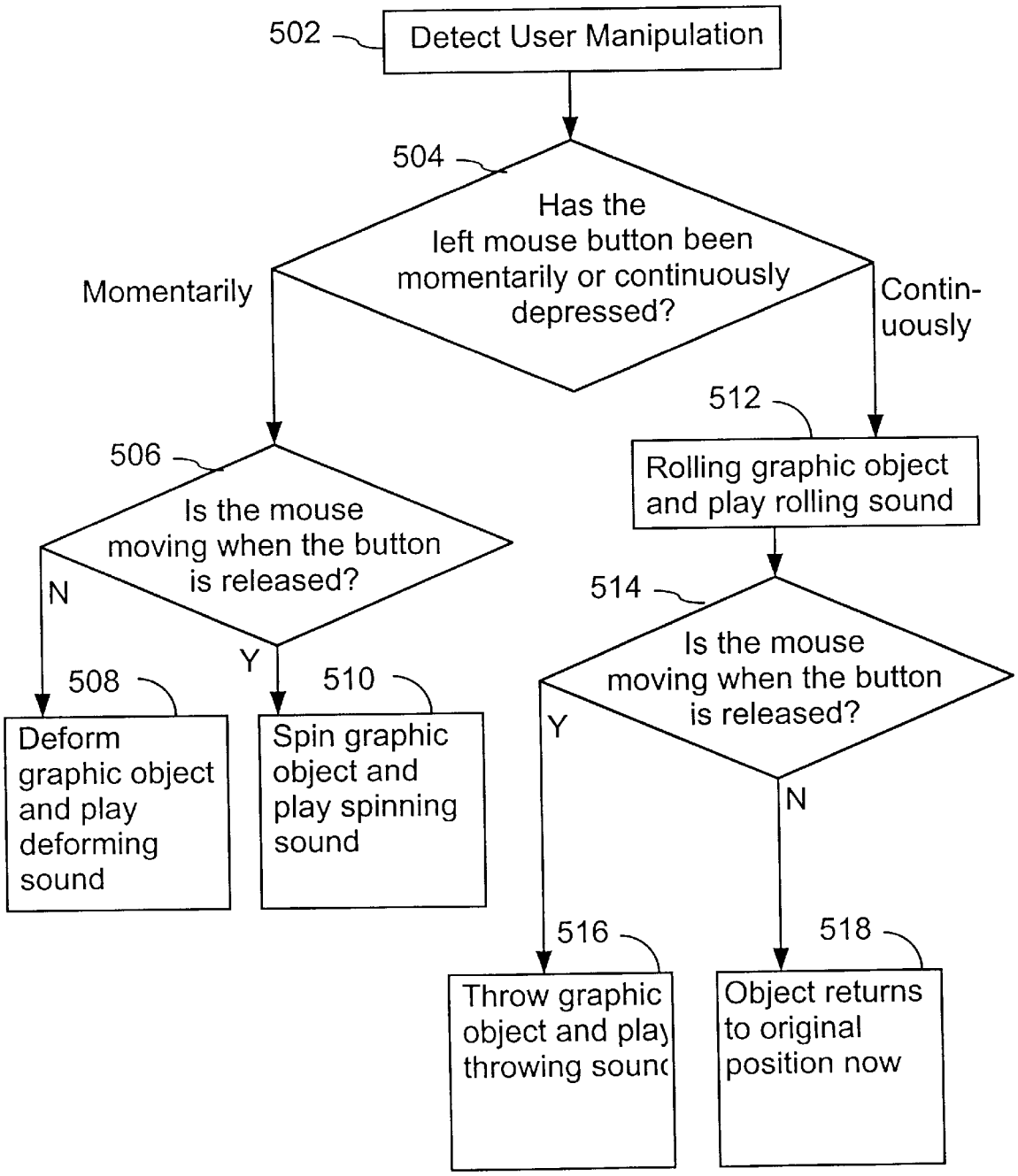
FIG. 5 depicts a flowchart describing steps of interpreting performance gestures of a single performer in accordance with one embodiment of the present invention.

The mappings themselves will be discussed in reference to FIG. 5 which depicts a flowchart describing steps of interpreting input from a single performer and generating output responsive to the input, in accordance with one embodiment of the present invention. At step 502, computer system 10 detects a user manipulation of mouse 46. In one embodiment, manipulations that cause generation of a position signal only with no generation of a selection signal are ignored, e.g., moving mouse 46 without depressing a button has no effect. In other embodiments, such manipulations may be used to move a cursor to permit selection of one of a number of graphic objects. At step 504, computer system 10 determines whether the left button of mouse 46 has been depressed momentarily or continuously. This is one criterion for distinguishing among different possible performance gestures.

Figure 6:
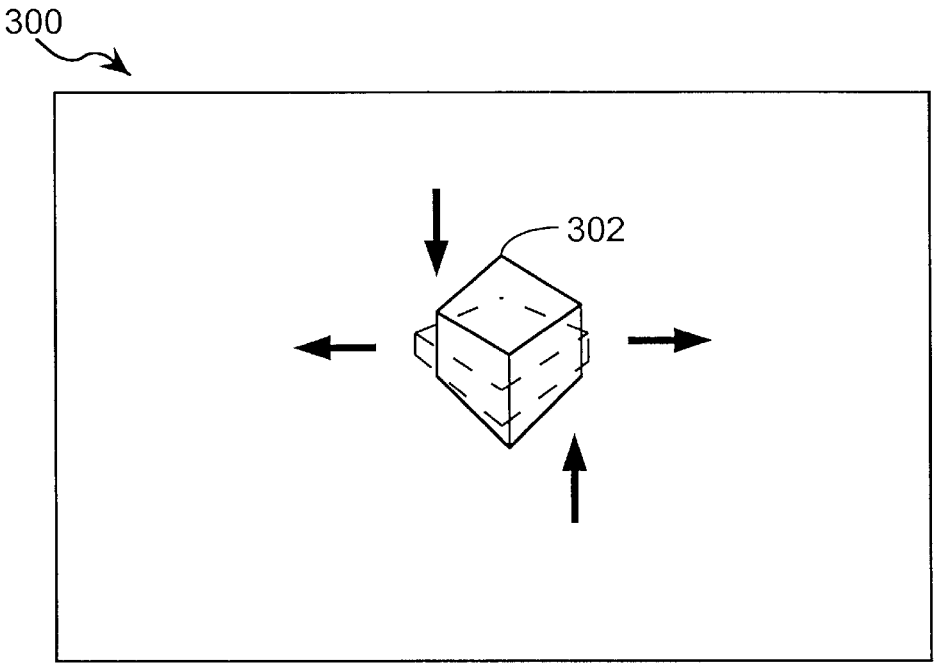
FIGS. 6 depicts a graphic object deforming in response to a performance gesture in accordance with one embodiment of the present invention.

If the depression is momentary, at step 506, computer system 10 determines whether the mouse is moving at the time the button is released. If the mouse is not moving, when the button is released, the performance gesture is a "Deform" gesture. In response, at step 508, the graphic object compresses as if the object were gelatinous and then reassumes its original form. The object compresses horizontally and stretches vertically, then compresses vertically and stretches horizontally before returning to its original form. FIG. 6 depicts graphic object 302 deforming in this way. Simultaneously, a musical segment is generated having as a global feature, e.g., a falling and rising glissando closely synchronized with the change of shape of the graphic object. A glissando is a succession of roughly adjacent tones.

Figure 7:
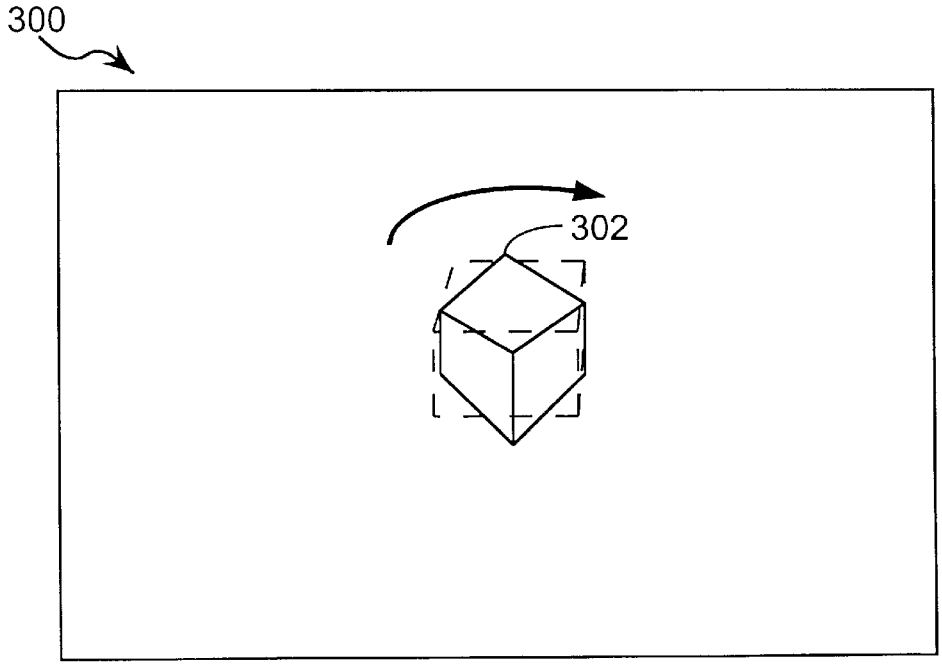
FIGS. 7 depicts a graphic object spinning in response to a performance gesture in accordance with one embodiment of the present invention.

If the mouse if found to be moving at step 506, the performance gesture is a "Spin" gesture. In response, at step 510, the graphic object begins rotating without translation. The initial speed and the direction of the rotation depend on the magnitude and direction of the mouse velocity at the moment the button is released. The rotation speed gradually decreases over time until rotation stops. FIG. 7 depicts a graphic object 302 spinning in this way. A generated musical segment has several global features which are isomorphically coherent with the spinning. One global feature is a series of embellishments to the melodic patterns with many fast notes of equal duration e.g., a series of grace notes. Another global feature is that the speed of notes in the musical segment tracks the speed of rotation of the graphic object. The average pitch, however, remains constant with no change in gross pitch trajectory. After the graphic object stops spinning, musical segment ends.

Figure 8:
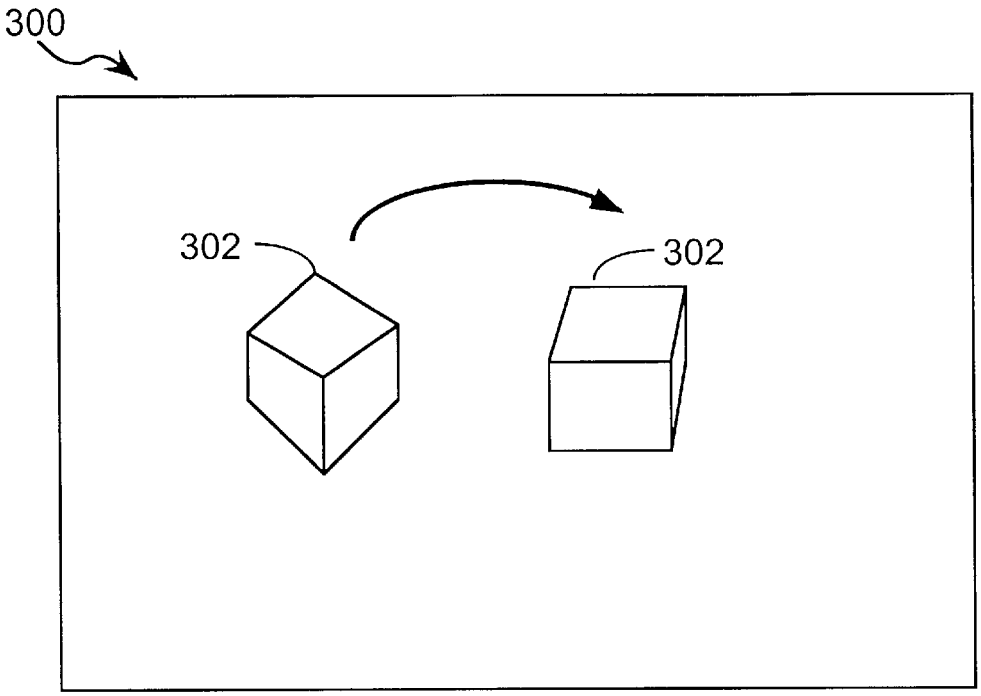
FIGS. 8 depicts a virtual object rolling in response to a performance gesture in accordance with one embodiment of the present invention.

If at step 504, it has been determined that the left mouse button has been continuously depressed rather than momentarily, (e.g., longer than a threshold duration) the performance gesture is either a "Roll" or a "Fly" depending on whether the mouse is moving when the button is released. The response to the "Fly" gesture includes the response to the "Roll" gesture and an added response. At step 512, the graphic object both rotates and translates to give the appearance of "rolling." Lateral movement of the mouse causes the object to move left or right. Vertical movement of the mouse causes the graphic object to move nearer or farther from the viewer's position in the visual display space. The rolling action begins as soon as the button depression exceeds a threshold duration. FIG. 8 depicts the rolling motion of graphic object 302.

Step 512 also includes generating a music segment with global features that are isomorphically coherent with the rolling motion of the graphical object. One global feature is the presence of wandering melodic patterns with notes of duration dependent upon rolling speed. The pitch content of these patterns may depend on the axis of rotation. The speed of notes varies with the speed of rotation. After the rolling motion stops, the music stops also.

Figure 9:
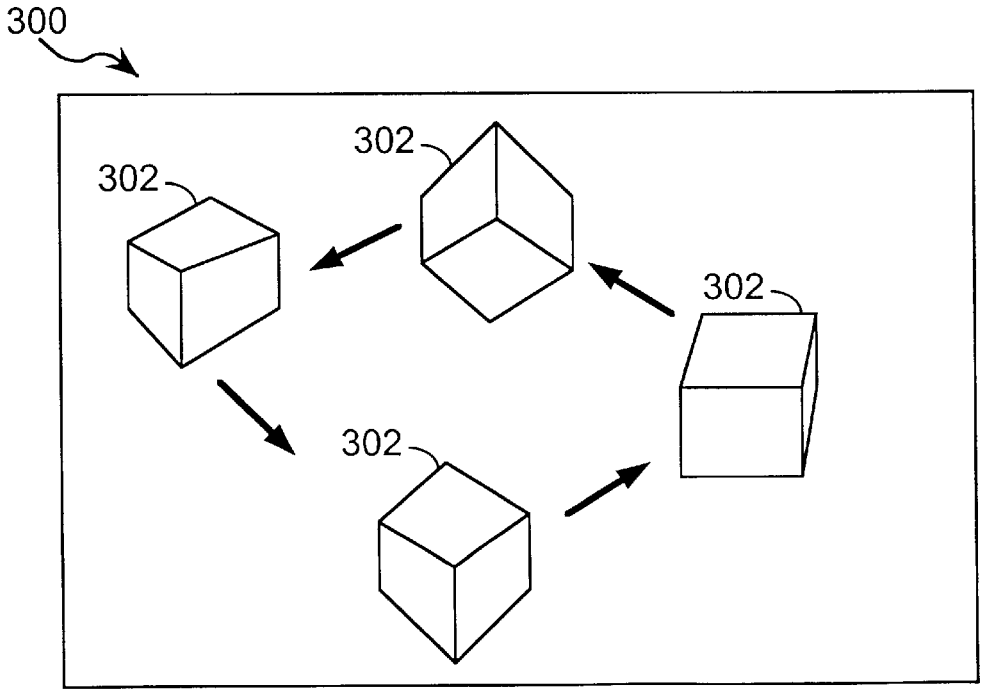
FIGS. 9 depicts a virtual object following a boomerang-like trajectory in response to a performance gesture in accordance with one embodiment of the present invention.

At step 514, computer system 10 determines whether the mouse is moving when the button is released. If at step 514, it is determined that the mouse is in fact moving when the left button is released, the performance gesture is a "Fly" gesture. The further visual and aural response associated with the "Fly" gesture occurs at step 516. After the button is released, the graphic object continues to translate in the same direction as if thrown. The graphic object then returns to its initial position in a boomerang path and spins in place for another short period of time with decreasing rotation speed. FIG. 9 depicts the flying motion of graphic object 302.

In step 516, the musical output continues after the button is released. A musical segment is generated with global features particular to flying. One global feature is that tempo and volume decrease with distance from the viewer's position in visual display space 300 as the graphic object follows its boomerang path. Another global feature is an upward and downward glissando effect that tracks the height of the graphic object in visual display space 300. The parameters of pitch, tempo, and volume thus track the trajectory followed by the graphic object. When after return to its initial position the graphic object spins in place, the same musical output is produced as would be produced in response to the "Spin" gesture.

If, it is determined at step 514 that the mouse is not moving when the button is released, the performance gesture is a "Roll" gesture and the visual and aural response is largely complete. The graphic object now returns to its original position at step 518.

Mappings For a Multiple Performer System

There are many ways to combine the input of multiple performers in the context of the present invention. One way is to assign each performer his or her own graphic object within visual display space 300. Each performer views his or her own perspective into visual display space 300, either on separate display screens or on the same display screen. Each performer also has his or her own input device. The response to each performer's gestures follows as indicated in FIGS. 4–9 with the musical output being summed together. A single computer system 10 may implement this multiperformer system. Alternatively, a multiple performer system may be implemented with multiple computer systems 10 connected by network 200. A selected computer system 10 may be designated to be a master station (or server) to sum together the sounds and specify the position and motion of each graphic object within the common display space. The elected computer system distributes the integrated sound output and the information necessary to construct the individual perspectives over network 200 to the client systems.

In other multiple performer embodiments, a single graphic object is controlled by multiple performers. In one such embodiment, individual global features of the same musical segment are controlled by different performers. In another embodiment, each global feature is controlled by integrating the input of multiple performers.

Figure 10:
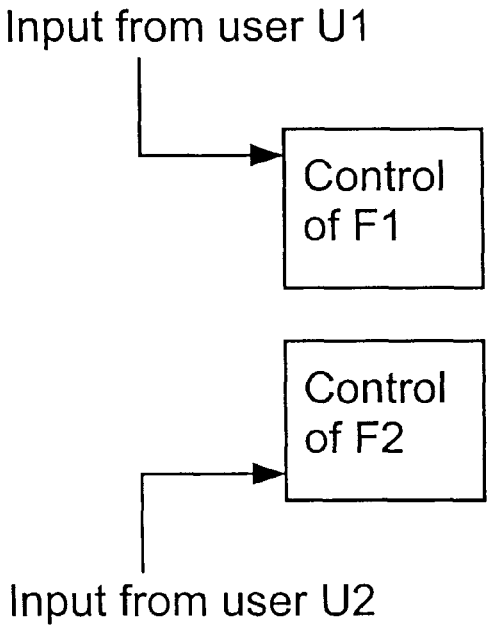
FIG. 10 depicts operation of a multiple-performer system wherein multiple performers control independent global features of the same musical segment in accordance with one embodiment of the present invention.

Consider an example of the first situation where a first user (U1) controls a first global feature (F1) of a musical segment and a second user (U2) controls a second global feature (F2) of the same musical segment. FIG. 10 depicts a graphical representation of this situation. In an ongoing production of musical sound, a repetitive rhythm track sets up an expectation in both users concerning when in time a new musical segment might likely be initiated. U1 and U2 both perform a "mouse-down" within a threshold duration surrounding this time when a musical segment might likely begin (eg., within the duration of an eighth note before or after this time). This "mouse-down" from U1 and U2 is identified as the beginning of a performance gesture from each user that can control separate features of a common music segment. U1 then performs a movement of the mouse that controls F1, which could be the pitch contour of a series of eight notes. By moving the mouse to the right, U1 indicates that the pitch will increase over the duration of the segment. U2 performs a leftward movement of the mouse which indicates, for example, that F2, the durations of the individual notes will decrease over the duration of the segment. So, in this example, the pitch of each subsequent note in the series of eight notes is higher than the previous note, and the duration of each subsequent note is also shorter. A desirable consequence of this multi-user control is that the individual user may learn to anticipate what the other user might next perform, so that the music segment that results from the independent performances has a pleasing quality.

Figure 11:
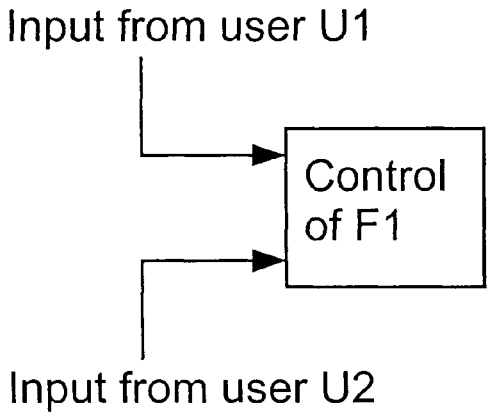
FIG. 11 depicts operation of a multiple-performer system wherein multiple performers control the same global feature of a musical segment in accordance with one embodiment of the present invention.

Consider an alternative example where a first user U1 and a second user U2 jointly control the same global feature, F1, of a musical segment. FIG. 11 depicts a graphical representation of this situation. Two users again perform a "mouse-down" within a threshold duration (of each other's mouse-down or a pre-determined point in the music production). The music generating system assigns control from U1 and U2 to converge on a single global feature, F1. A natural application of this mode of multi-user control would be to control the density of the percussive instrumentation composing a rhythm track. The users effectively "vote" on how dense the rhythmic accompaniment will be. By moving the mouse to the right, each user indicates that more notes per beat and more component percussive instruments (i.e., higher density) are included in the rhythm track. The "voting" mechanism can be implemented as a simple averaging of user inputs, and naturally allows for two or more users to contribute to the resulting control level on the density feature, F1.

A desirable consequence of this type of multi-user control comes from the potential sense of collaboration in shaping the overall quality of a music production. One application of the "density" example is having multiple users listening to a pre-determined melody over which they have no control while they attempt to shape the rhythmic accompaniment so that it seems to match or complement that melody well. Of course, an additional user might not be contributing to the "density" voting process but rather might be actively shaping the melody that U1 and U2 are responding to while shaping the rhythmic accompaniment. For example, a "guest artist" controls a solo performance of a melody while a group of "fans" shape the accompaniment in response to the changing character of the guest artist's solo melody. One possible effect is that the group can in turn influence the guest artist via changes in the accompaniment.

In the foregoing specification, the invention has been described with reference to specific exemplary embodiments thereof. It will, however, be evident that various modifications and changes may be made thereunto without departing from the broader spirit and scope of the invention as set forth in the appended claims and their full scope of equivalents.

What is claimed is:

1. A computer-implemented method for interactively generating music comprising the steps of:

a) receiving a first sequence of performance gestures from a first human performer via a first input device;

b) receiving a second sequence of performance gestures from a second human performer via a second input device;

c) varying an appearance of graphic objects in a visual display space responsive to said first sequence and said second sequence;

d) displaying a first perspective of said visual display space to said first human performer;

e) displaying a second perspective of said visual display space to said second human performer, wherein said first perspective and said second perspective are non-identical; and f) generating music responsive to said first sequence and said second sequence, wherein at least one particular performance gesture of one of said first and second sequences causes generation of a musical segment with global features selected in accordance with said particular performance gesture.

2. The method of claim 1, wherein the varying step, in response to a first gesture in the first or second sequence of performance gestures, continues to vary the appearance of at least one of the graphic objects after completion of the first gesture in a manner determined by the first gesture;

there is an isomorphic coherence between said musical sound and said changes in appearance.

3. The method of claim 2 wherein a particular graphic object begins spinning with no translation in response to said particular performance gesture.

4. The method of claim 3 wherein a spinning speed of said graphic object decreases following said particular performance gesture until said graphic object stops spinning and a tempo of said musical segment varies responsive to said spinning speed.

5. The method of claim 3 wherein said musical segment ends when said graphic object stops spinning.

6. The method of claim 2 wherein a particular graphic object rolls in response to said particular performance gesture.

7. The method of claim 2 wherein said graphic object moves away from an initial position and returns in a boomerang trajectory in response to said particular performance gesture.

8. The method of claim 7 wherein said musical segment incorporates an upward glissando effect as said graphic object moves away and a downward glissando effect as said graphic object returns.

9. The method of claim 7 wherein a tempo of said musical segment varies responsive to a distance of said graphic object from said initial position.

10. The method of claim 1 wherein said first perspective and said second perspective are displayed on a single display screen.

11. The method of claim 1 wherein said first perspective and said second perspective are displayed on independent display screens.

12. A computer-implemented method for interactively generating music comprising the steps of:

receiving from a user input device a position signal and at least one selection signal that are generated by the user input device in response to a user gesture that is manifested by manipulation of said user input device;

displaying a graphic object;

varying an appearance of said graphic object responsive to said position signal and said at least one selection signal, and continuing to vary the appearance of said graphic object after completion of the user gesture in a manner determined by the user gesture; and generating a musical segment having at least one global feature selected responsive to said monitored position signal and said monitored at least one selection signal, wherein said musical segment is isomorphically coherent with variation of appearance of said graphic object.

13. The method of claim 12 wherein said graphic object appears to begin motion in response to said user manipulation.

14. The method of claim 13 wherein said motion comprises translational motion.

15. The method of claim 13 wherein said motion comprises rotational motion.

16. The method of claim 13 wherein said motion comprises rotational and translational motion.

17. The method of claim 13 wherein said at least one global feature of said musical segment varies with a position of said graphic object during said motion.

18. The method of claim 12 wherein said varying step comprises deforming a shape of said graphic object in response to a particular user manipulation.

19. The method of claim 18 wherein said at least one global feature is a pitch height of said musical segment that varies in response to height of said graphic object as it deforms.

20. The method of claim 18 wherein said particular user manipulation includes momentary activation of said selection signal without position signal input.

21. The method of claim 12 wherein said varying step comprises rotating said graphic object without translation in response to a particular user manipulation, wherein a rotating speed of said graphic object varies over time.

22. The method of claim 21 wherein said at least one global feature is a tempo that varies in response to said rotating speed.

23. The method of claim 21 wherein said particular user manipulation includes momentary activation of said selection signal simultaneous with position signal input.

24. The method of claim 12 wherein said varying step comprises rotating and translating said graphic object in response to a particular user manipulation.

25. The method of claim 24 wherein a rotating speed of said graphic object varies over time and said at least one global feature is a tempo that varies responsive to said rotating speed.

26. The method of claim 24 wherein said at least one global feature includes melodic patterns with many fast notes of equal duration.

27. The method of claim 24 wherein said particular user manipulation includes a non-momentary activation of said selection signal simultaneous with position signal input that ends before said selection signal activation.

28. The method of claim 12 wherein said varying step comprises translating said graphic object from a current position and returning said graphic object to said current position in response to a particular user manipulation.

29. The method of claim 28 wherein said at least one global feature includes a musical parameter that tracks a trajectory of said graphic object.

30. The method of claim 28 wherein said particular user manipulation includes a non-momentary activation of said selection signal simultaneous with position signal input that lasts longer than said selection signal activation.

31. A computer-implemented method for interactively generating music comprising the steps of:

a) receiving a first performance gesture from a first human performer via a first input device;

b) receiving a second performance gesture from a second human performer via a second input device;

c) varying an appearance of one or more graphic objects in a visual display space responsive to said first performance gesture and said second performance gesture; and d) generating a musical segment with one or more global features specified in response to said first performance gesture and said second performance gesture.

32. The method of claim 31 wherein said d) step comprises specifying a single global feature in response to said first performance gesture and said second performance gesture.

33. The method of claim 31 wherein said d) step comprises specifying a first global feature in response to said first performance gesture with no input from said second performance gesture and specifying a second global feature in response to said second performance gesture with no input from said first performance gesture.

34. The method of claim 31 wherein said c) step comprises:

imparting motion to a first graphic object in response to said first performance gesture; and imparting motion to a second graphic object in response to said second performance gesture.

35. The method of claim 31 wherein said c) step comprises:

imparting motion to a single graphic object in response to said first performance gesture and said second performance gesture.

* * * * *

UNITED STATES PATENT AND TRADEMARK OFFICE

CERTIFICATE OF CORRECTION

PATENT NO. : 5,952,599
APPLICATION NO. : 08/977377
DATED : September 14, 1999
INVENTOR(S) : Thomas Dolby et al.

It is certified that error appears in the above-identified patent and that said Letters Patent is hereby corrected as shown below:

On the Title Page, add the following paragraph:

--(60) Related U.S. Application Data
This patent claims priority from U.S. Provisional Patent Application No. 60/064,860 entitled "Interactive Music Generation System Making Use of Global Feature Control By Non-Musicians" filed December 19, 1996.--

Column 1, before line 5, insert the following paragraph:

--Cross-Reference To Related Application
This application claims the benefit of U.S. Provisional Patent Application No. 60/064,860, filed December 19, 1996, the disclosure of which is incorporated by reference.--

Signed and Sealed this

Nineteenth Day of January, 2010

David J. Kappos

David J. Kappos
*Director of the United States Patent and Trademark Office*